US011469545B2

(12) United States Patent
Scianna et al.

(10) Patent No.: US 11,469,545 B2
(45) Date of Patent: Oct. 11, 2022

(54) UNDERWATER VEHICLE MODULE CONNECTOR

(71) Applicant: Foster-Miller, Inc., Waltham, MA (US)

(72) Inventors: Christopher Peter Scianna, Southborough, MA (US); Timothy James Przybylowicz, Scarborough, ME (US); Joshua Thomas Bricknell, Medford, MA (US)

(73) Assignee: Foster-Miller, Inc., Waltham, MA (US)

( * ) Notice: Subject to any disclaimer, the term of this patent is extended or adjusted under 35 U.S.C. 154(b) by 4 days.

(21) Appl. No.: 17/117,481

(22) Filed: Dec. 10, 2020

(65) Prior Publication Data

US 2022/0190509 A1 Jun. 16, 2022

(51) Int. Cl.
*H01R 13/52* (2006.01)
*H01R 13/523* (2006.01)

(52) U.S. Cl.
CPC ..... *H01R 13/523* (2013.01); *H01R 13/5202* (2013.01); *H01R 2201/26* (2013.01)

(58) Field of Classification Search
CPC ..... H01R 13/523; H01R 13/5202; H01R 2201/26
USPC ..... 439/271
See application file for complete search history.

(56) References Cited

U.S. PATENT DOCUMENTS 3,412,365 A * 11/1968 Nelson ..... H01R 13/523 439/651
3,678,872 A * 7/1972 Migliaccio ..... B63G 8/41 114/316
4,996,938 A * 3/1991 Cameron ..... A63B 35/12 440/6
5,537,947 A * 7/1996 Couture ..... B63B 22/003 114/20.1
5,578,751 A * 11/1996 French ..... B63G 8/38 73/170.29
5,995,882 A * 11/1999 Patterson ..... B63B 27/36 701/532
7,290,496 B2 * 11/2007 Asfar ..... B63G 8/001 114/333
7,337,741 B1 * 3/2008 Ansay ..... B63G 8/001 114/239
7,417,666 B2 * 8/2008 Kaltenbacher ..... H04N 13/254 348/148
7,465,201 B1 * 12/2008 Thivierge ..... B63H 25/46 114/166
7,721,669 B1 5/2010 Portmann et al.
(Continued)

*Primary Examiner* — Abdullah A Riyami
*Assistant Examiner* — Vladimir Imas
(74) *Attorney, Agent, or Firm* — Iandiorio Teska & Coleman, LLP

(57) ABSTRACT

An underwater vehicle module connector includes a first mating ring connected to a first module and including a first bulkhead sealing the first module, a first electrical connector extending outward from the first bulkhead, and a first coupling mechanism. A second mating ring is connectable to a second module and includes a second bulkhead sealing the second module, a second electrical connector extending outward from the second bulkhead, and a second coupling mechanism. The first and second couplers are configured to releasably couple the first mating ring to the second mating ring and mate the first electrical connector with the second electrical connector.

42 Claims, 9 Drawing Sheets

(56) References Cited

U.S. PATENT DOCUMENTS

| | | | | |
|---|---|---|---|---|
| 8,033,677 | B1 * | 10/2011 | Olsson | F21V 7/0083 362/267 |
| 8,267,707 | B2 * | 9/2012 | Rogers | H01R 13/52 439/271 |
| 8,539,898 | B1 * | 9/2013 | Sylvia | B63G 8/18 114/312 |
| 9,315,248 | B2 * | 4/2016 | Williams | B63B 73/20 |
| 9,816,856 | B2 * | 11/2017 | Kocak | G01J 1/0266 |
| 10,054,287 | B2 * | 8/2018 | Fieberg | F21V 25/10 |
| 10,093,403 | B2 * | 10/2018 | Williams | B25J 9/08 |
| 10,106,237 | B2 * | 10/2018 | Kaiser | H02K 5/1732 |
| 10,577,064 | B2 * | 3/2020 | Williams | B63G 8/001 |
| 10,704,766 | B2 * | 7/2020 | Fieberg | F21V 23/06 |
| 10,773,780 | B2 * | 9/2020 | Smith | B63G 8/001 |
| 2002/0033126 | A1 * | 3/2002 | Tolkoff | F16B 2/08 114/20.1 |
| 2002/0049012 | A1 * | 4/2002 | Kirkwood | F42B 19/12 440/67 |
| 2014/0230714 | A1 | 8/2014 | Sylvia et al. | |

* cited by examiner

UNDERWATER VEHICLE MODULE CONNECTOR

FIELD OF THE INVENTION

This invention relates to underwater vehicles.

BACKGROUND OF THE INVENTION

Underwater vehicles include remotely operated vehicles (ROVs), unmanned underwater vehicles (UUVs), autonomous profiling vehicles (APVs), and autonomous underwater vehicles (AUVs). See U.S. Pat. No. 5,995,882 incorporated herein by this reference.

Single pressure hulls include the vehicle electronics, sensors, batteries, motors, and the like in a single sealed usually cylindrical hull.

Modular designs, in contrast, includes serial modules coupled to each other. For example, a propulsion module may be coupled to a battery module itself coupled to a navigational sensor module. Various means for coupling any two modules together are known. See U.S. Pat. Nos. 7,721,669 and 8,539,898 and published application No. 2014/0230714 all incorporated herein by this reference. In this way, battery modules can be swapped out and one or more sensor modules can be replaced for different missions.

U.S. Pat. No. 8,539,898 discloses, for example, a quick connect bulkhead between a payload module and a central body module having guidance, navigation, and communications electronics. But, when coupled together, the payload module and the body module constitute a single sealed hull and wires passed from the payload module to the central body module through the open quick connect bulkhead. Though simple, this method exposes the internal cavity of each module to the external environment during assembly and disassembly reducing the feasibility of creating field swappable modules. Since the addition of any new module to this layout is an extension of the base vehicle pressure hull, each time a section is added all the vehicle seals must be re-verified prior to use. This makes the prospect of field swapping a given module unlikely.

SUMMARY OF THE INVENTION

Featured in one example is a module connector that seals both modules individually before the modules are connected together protecting the electronic and other components internal to each module.

Also featured, in one example, is a module connector configured to automatically make an electrical connection between modules when they are joined mechanically. Also featured is a module connector that can be flooded for sensors such as pressure sensors that require contact with the surrounding fluid (e.g., water). Also featured is a module connector that is easy to use and which is not unduly complex.

Featured is an underwater vehicle module connector comprising a first mating ring connected to a first module and including a first bulkhead sealing the first module, a first electrical connector extending outward from the first bulkhead, and a first coupling mechanism. A second mating ring is connectable to a second module and includes a second bulkhead sealing the second module, a second electrical connector extending outward from the second bulkhead, and a second coupling mechanism. The first and second couplers are configured to releasably couple the first mating ring to the second mating ring and mate the first electrical connector with the second electrical connector.

In one version, the first and/or second mating rings includes holes or slots therethrough for flooding the volume between the first and second bulkheads. The first mating ring bulkhead may include opposing first and second prongs and the second mating ring bulkhead includes opposing third and fourth prongs releasably engaging the first and second prongs, respectively, of the first mating ring. In one example, the first and second prongs are disposed on opposite sides of the first electrical connector and the third and fourth prongs are disposed on opposite sides of the second electrical connector. The first and second prongs may extend from first and second outwardly facing shelf members, respectively and the third and fourth prongs may extend from third and fourth inwardly facing shelf members, respectively.

In one version, the first electrical connector extends in a first direction between the first and second prongs and the second electrical connector faces a second opposite direction between the third and fourth prongs. The third and fourth prongs may engage the first and second outwardly facing shelf members, respectively, and the first and second prongs may engage the third and fourth inwardly facing shelf members, respectively. In one example, the first electrical connector extends at a right angle relative to the external surface of the first bulkhead and the second electrical connection extends at a right angle relative to the external surface of the second bulkhead.

In one version, the first mating ring further includes a first collar section insertable into the first module and the second mating ring further includes a second collar section insertable into the second module.

Also featured is an underwater vehicle comprising at least a first module sealed via a first bulkhead including an external surface with a first electrical connector. At least a second module is sealed via a second bulkhead including an external surface with a second electrical connector. A first mechanical coupling mechanism is present on the external surface of the first bulkhead and a second mechanical coupling mechanism is present on the external surface of the second bulkhead. The second mechanical coupling mechanism is configured to releasably engage the first mechanical coupler securing the first module to the second module and configured to mate the first electrical connector with the second electrical connector.

Also featured is a method of connecting two modules of an underwater vehicle. A first mating ring is connected to the first module, the first mating ring including a first bulkhead sealing the first module and a first electrical connector extending outward from the first bulkhead. A second mating ring is connected to a second module. The second mating ring includes a second bulkhead sealing the second module and a second electrical connector extending outward from the second bulkhead. The first mating ring is releasably coupled to the second mating ring while simultaneously the first electrical connector is mated with the second electrical connector.

The method may further include flooding the space between the first and second bulkheads.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
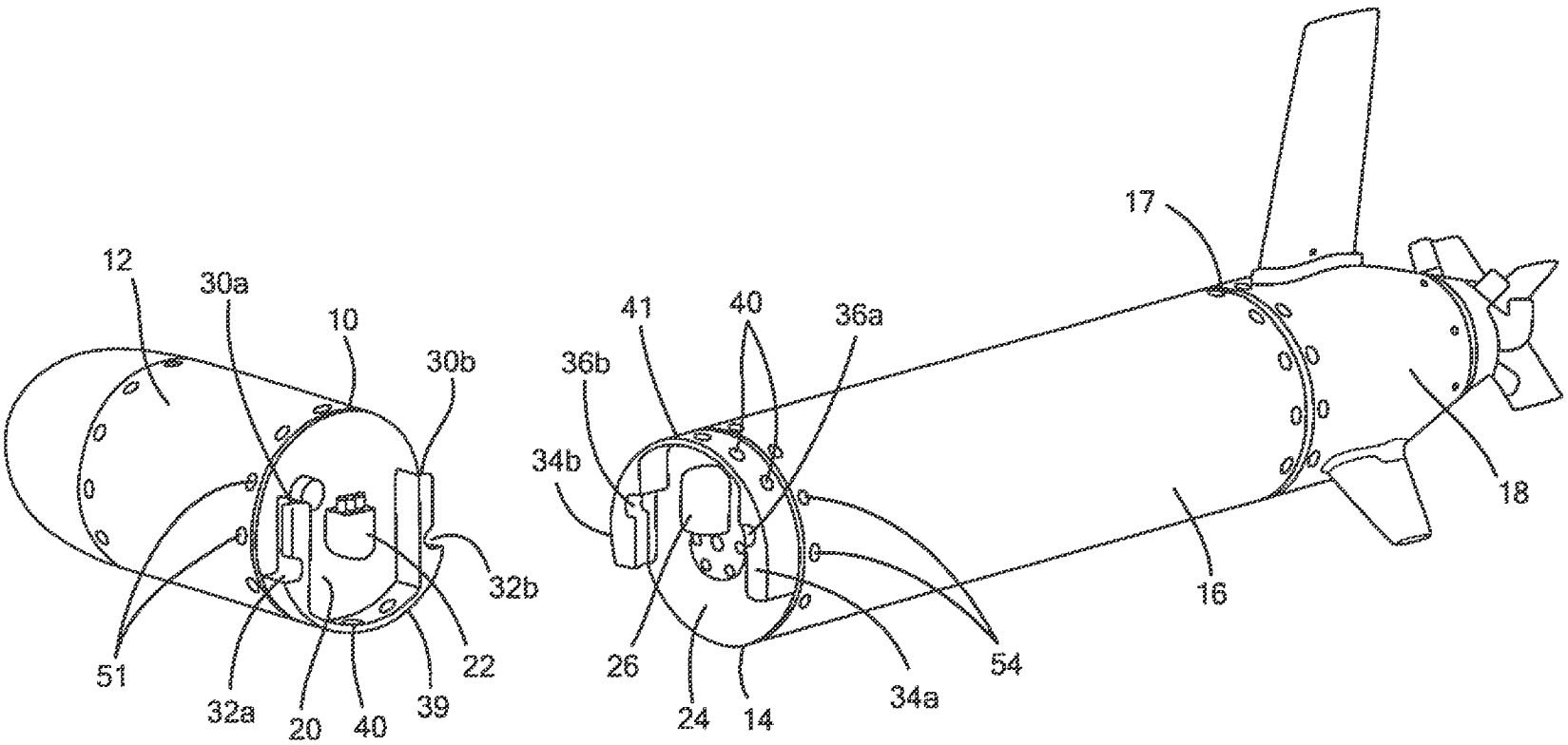
FIG. 1 is a schematic three-dimensional view showing how two separate modules are independently sealed before being electrically and mechanically coupled to another module.
Figure 2:
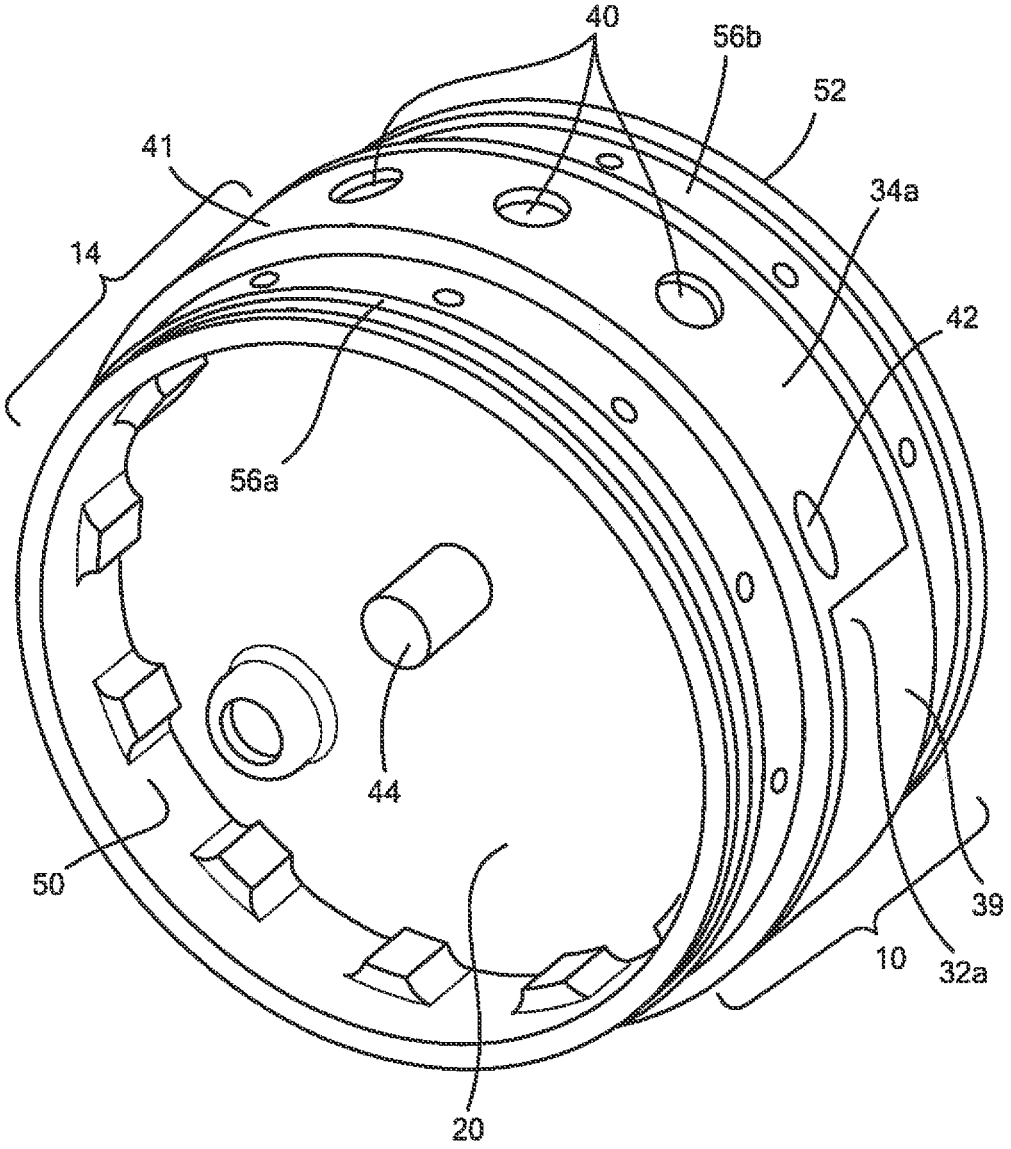
FIG. 2 is a three-dimensional schematic view showing an underwater vehicle module connector where the two mating rings are coupled together.
Figure 3:
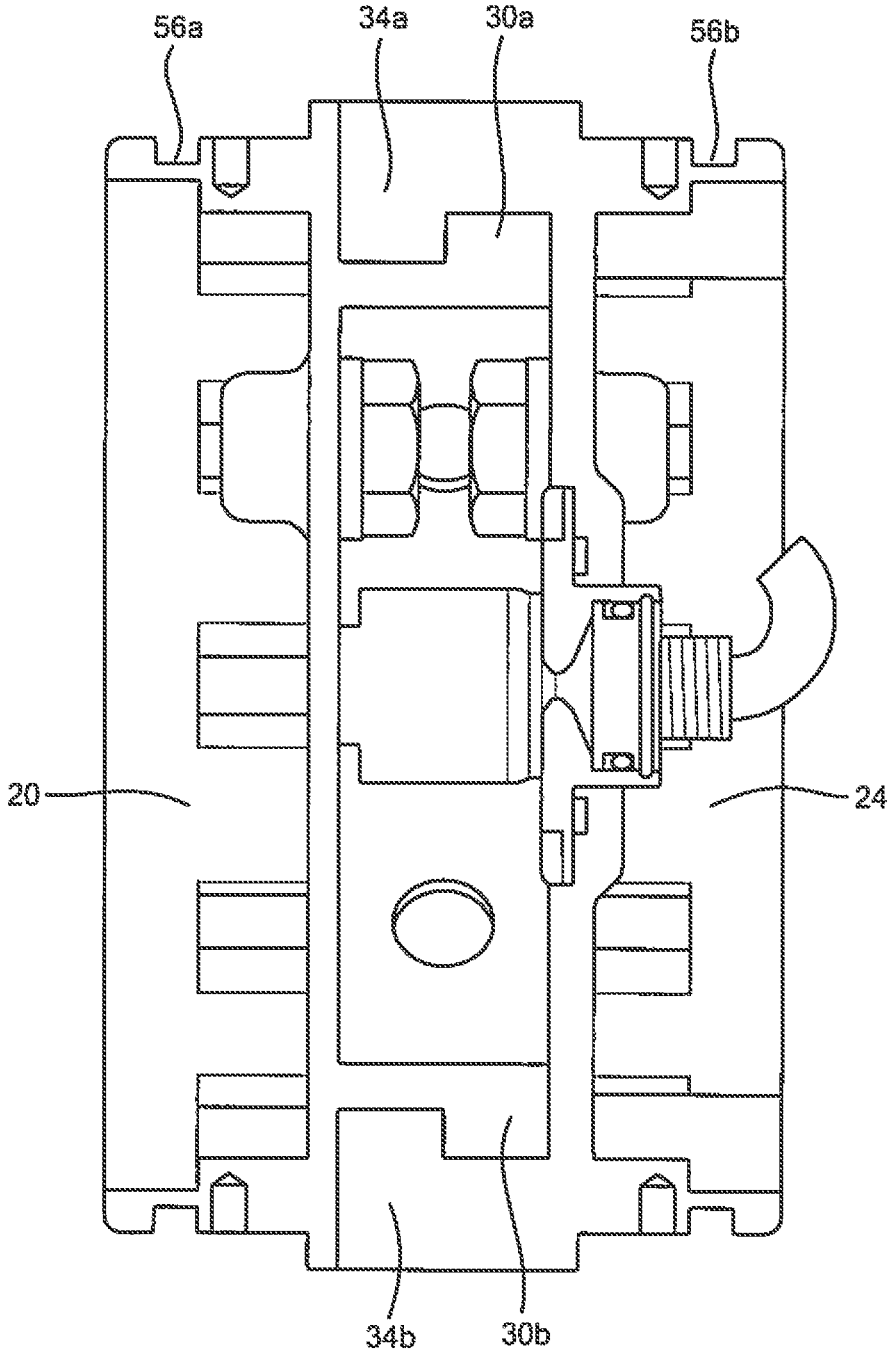
FIG. 3 is a top cutaway view of the connector of FIG. 2.
Figure 4:
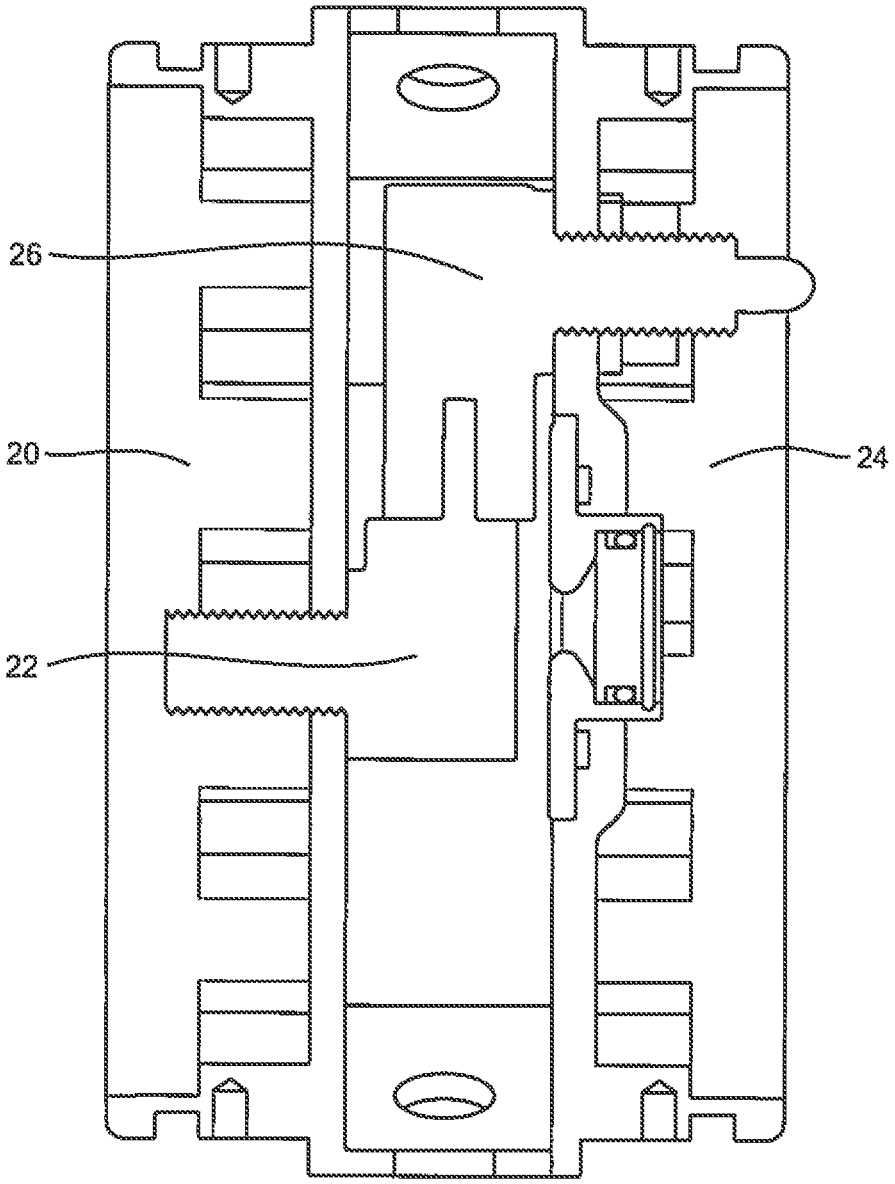
FIG. 4 is a side cutaway view of the connector of FIG. 2.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

In one example, shown in FIGS. 1-4, the underwater vehicle module connector includes mating ring 10 connectable to module 12 and mating ring 14 connectable to module 16. A similar connector can be used to couple propulsion module 18 to module 16 as shown at 17. In one preferred embodiment, mating ring 10 includes first bulkhead 20 which seals module 12. Right angle electrical plug 22 extends outward from bulkhead 20. Bulkhead 20 also includes a first mechanical coupler arrangement.

Mating ring 14 includes second bulkhead 24 which seals module 16. Electrical socket 26 extends outward at a right angle from bulkhead 24. Bulkhead 24 also includes a second mechanical coupler arrangement cooperating with the bulkhead 20 mechanical coupler arrangement mechanically interlocking the two mating rings. The mechanical coupler arrangements are configured so that when they mechanically interlock, right angle plug 22 is forced into right angle socket 26. The electrical socket and plug are preferably wet matable.

There are various possible mechanical coupler arrangements including rails and channels. In the version shown, bulkhead 20 includes spaced opposing prongs 30*a*, 30*b* on opposite sides of upwardly (in the figure) facing electrical plug 22 extending from respective first and second outwardly facing shelf features 32*a*, 32*b*. Bulkhead 24, in turn, includes spaced opposing prongs 34*a*, 34*b* on opposites sides of downwardly (in the figure) facing electric socket 26 each extending from respective inwardly facing shelf members 36*a*, 36*b*. In other designs, shelf member 32*a*, 32*b* are inwardly facing and shelf members 36*a*, 36*b* are outwardly facing. The distal ends of prongs 32*a*, 32*b* engage shelf members 36*a*, 36*b*, respectively, and the distal end of prongs 34*a*, 34*b* engage shelf members 32*a*, 32*b*, respectively, to interlock ring 10 and ring 14. One or more fasteners may be used to secure prongs 32*a*, 32*b* to prongs 34*a*, 34*b*. The fasteners may be installed through slot 42, FIG. 2. Ring 10 includes arcuate section 39 between shelf members 32*a* and 32*b* and ring 14 includes arcuate section 41 between the proximal ends of prongs 34*a*, 34*b*. When ring 10 is coupled to ring 14, arcuate sections 39 and 41 complete a ring structure along with the arcuate outer walls or prongs 34*a*, 34*b*.

Optional flood holes or slots 40 in the arcuate sections 39, 41 allow the space between bulkheads 20 and 24 to be flooded for pressure sensors and the like. Plug 22 may include electrical connection 44 extending through bulkhead 20 and the electrical socket 26 may include a corresponding electrical connector extending through bulkhead 24 to electrically interconnect electronic components in the interior of modules 12 and 16. A right angle plug and a right angle socket are preferred for space savings. In this way, power and signals can pass from one module to another.

Ring 10 includes in this particular design collar section 50 received in module 12 and secured via fasteners 51 and ring 14 includes collar section 52 received in module 16 and secured via fasteners 54. The collar sections abut the internal diameter of their respective modules. Each collar may include a groove 56 for an O-ring to seal the respective ring collar sections to their respective modules.

In this way, an underwater vehicle as shown includes one module sealed via a first bulkhead and a second module sealed via a second bulkhead. The external surface of each bulkhead includes at least one electrical connector. One or more bulkheads may also include fixtures for additional sensors and the like. The mating ring need not necessarily be circular. Disengagement of one module from another module is made easier. The resulting mating ring construction enhances a module type underwater vehicle making it easier to design new subassemblies, integrate preexisting subassemblies in new configurations, and field swap subassemblies. The modules are sealed independent of each other allowing a modular exchange of components without the need to create a seal between modules. The right-angle wet mate connectors and the right-angle interlock design minimizes axial displacement between modules. The modularly added via the examples shown extends a single battery charge life with ease by adding an extended battery subassembly. Different missions can be accomplished by swapping out different payload assemblies. Performance is increased and cost is decreased since a specific navigational sensor package can be selected for a specific mission. In addition, the vehicle is reusable for many different applications which is ideal for performing a diverse mission set. Via the wet matable electrical connectors, data and power is transferred between modules.

Figure 5:
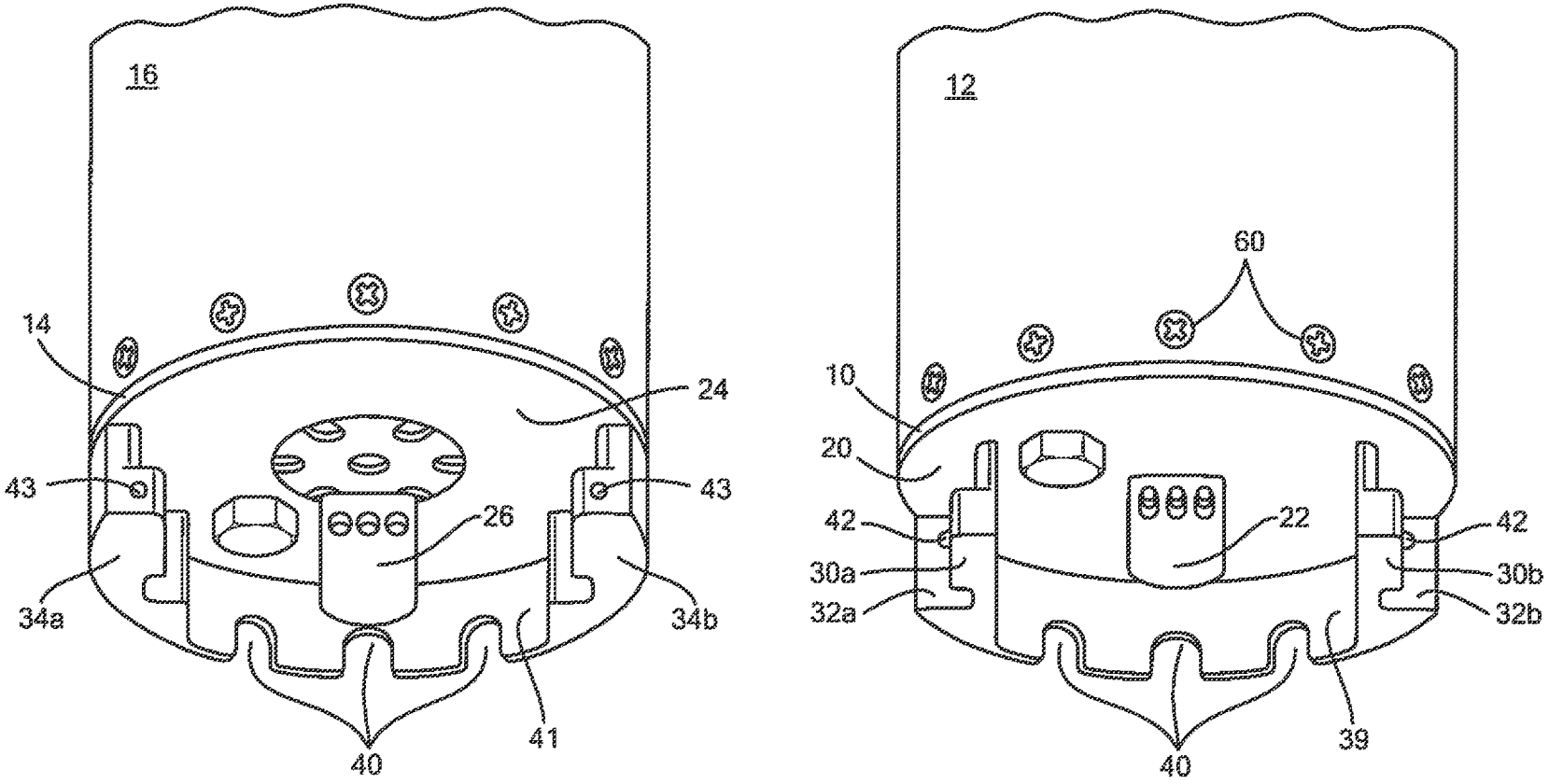
FIG. 5 is a three-dimensional schematic showing one mating ring connected to a first underwater vehicle module and another mating ring connected to a different underwater vehicle module.
Figure 6:
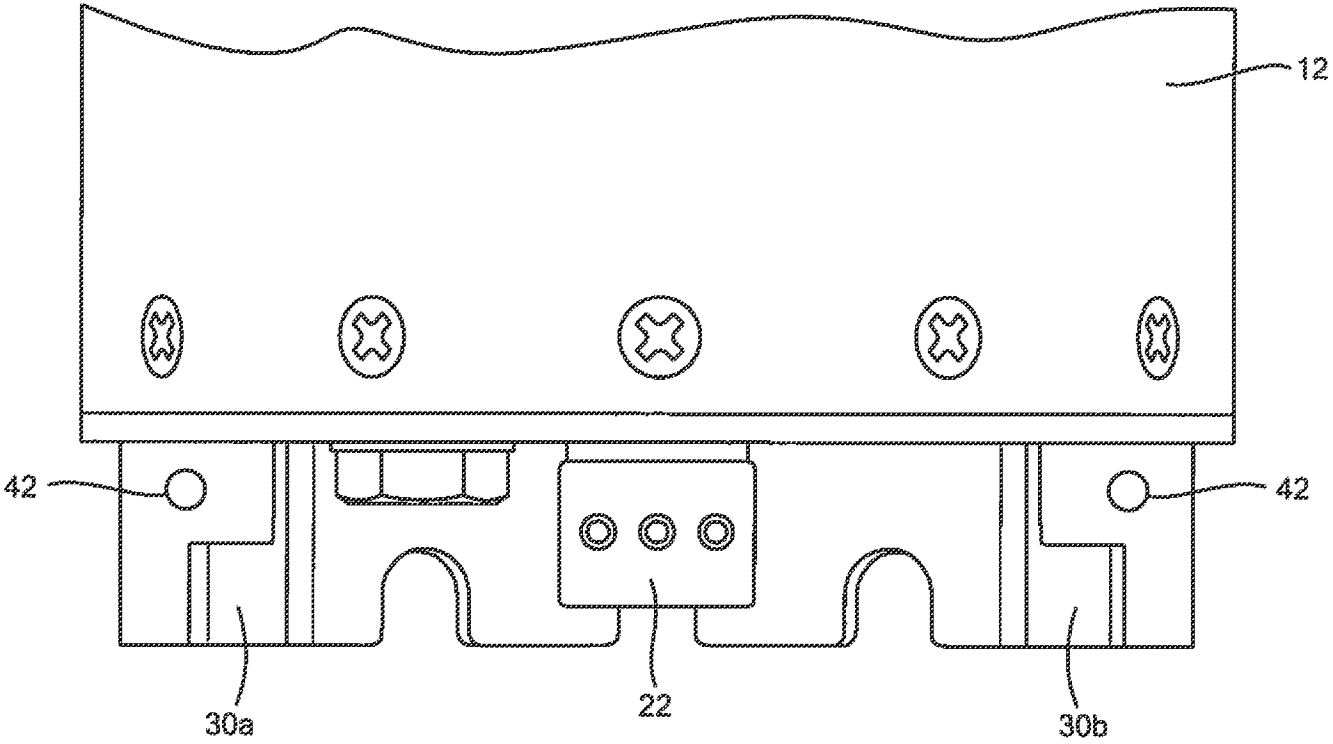
FIG. 6 is a top view of the first mating ring connected to a first module.
Figure 7:
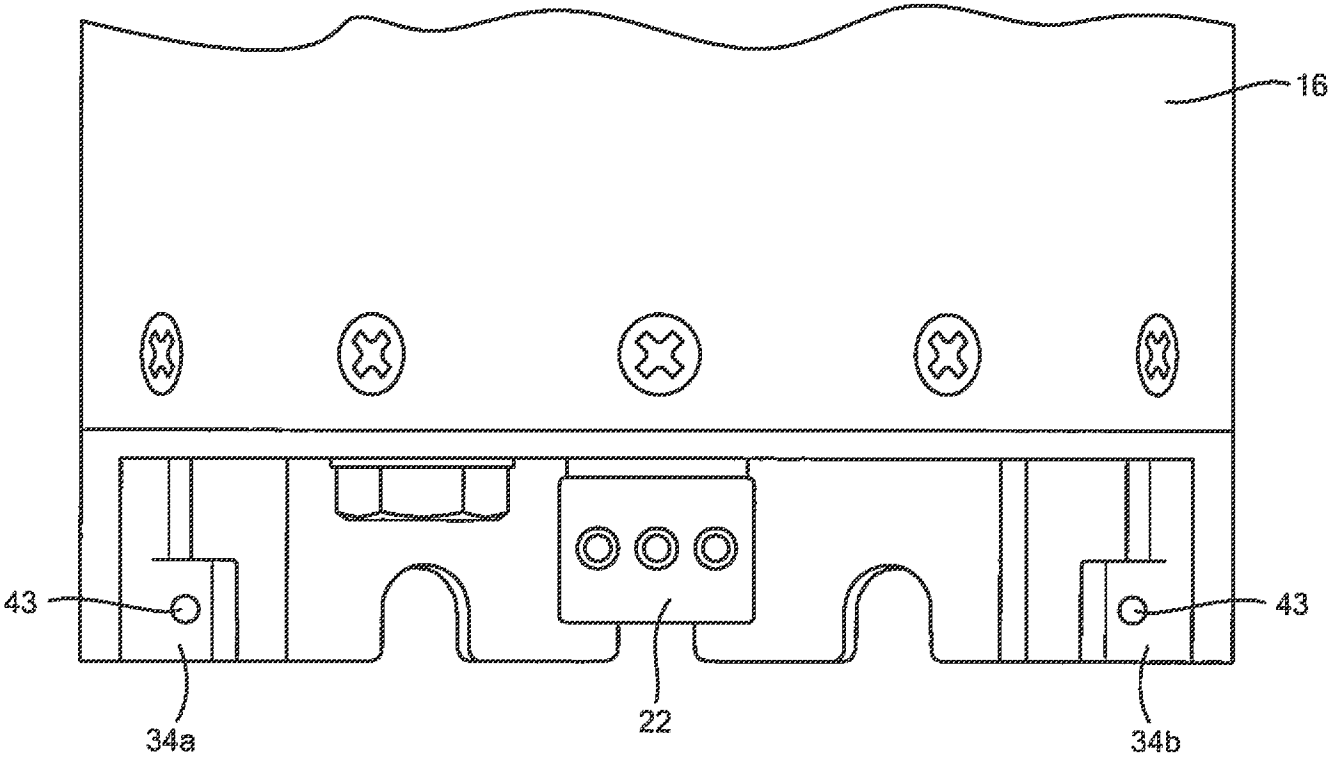
FIG. 7 is a top view showing a second mating ring connected to a second module.
Figure 8:
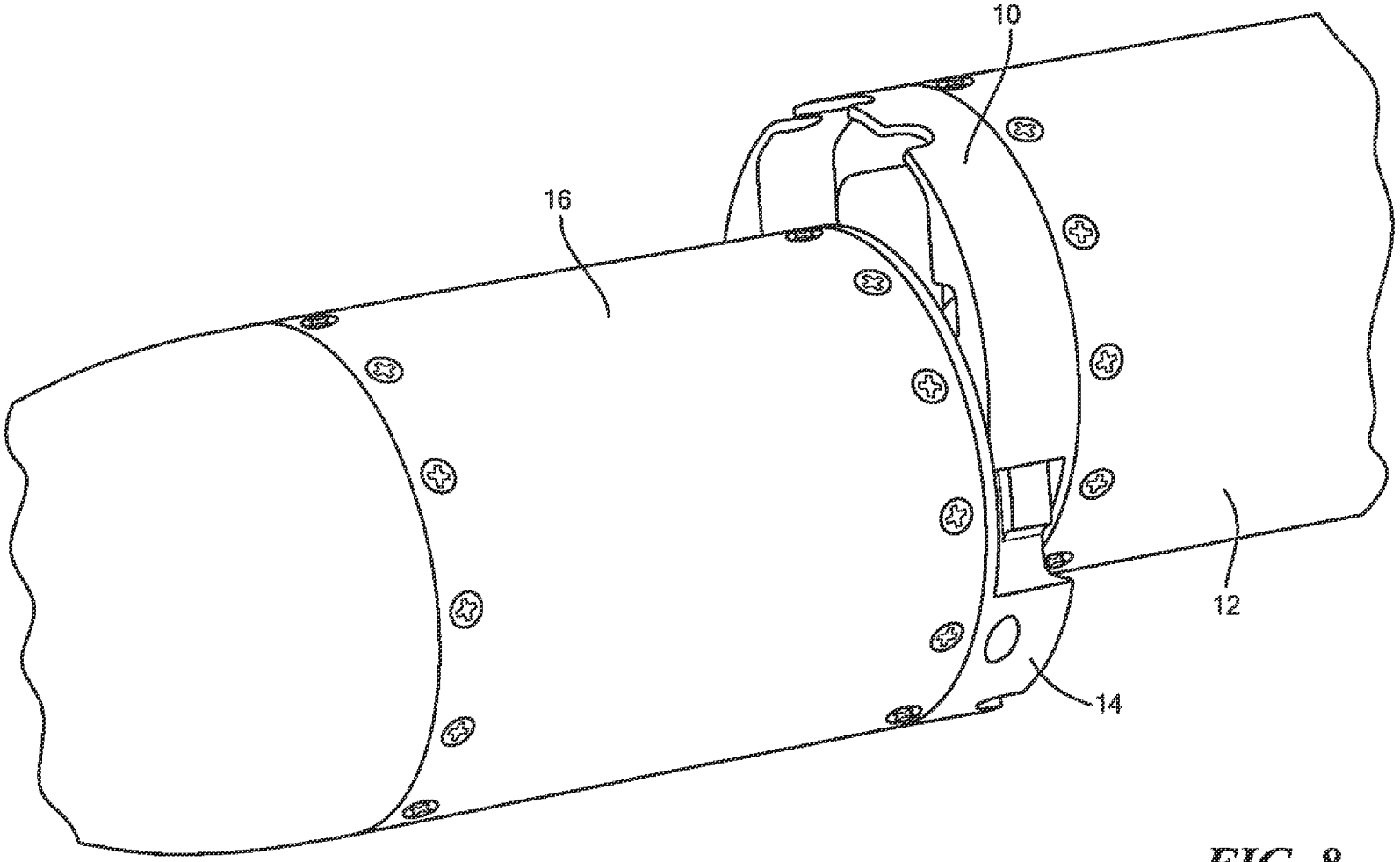
FIG. 8 is a three-dimensional schematic showing how the mating rings mechanically interlock.
Figure 9:
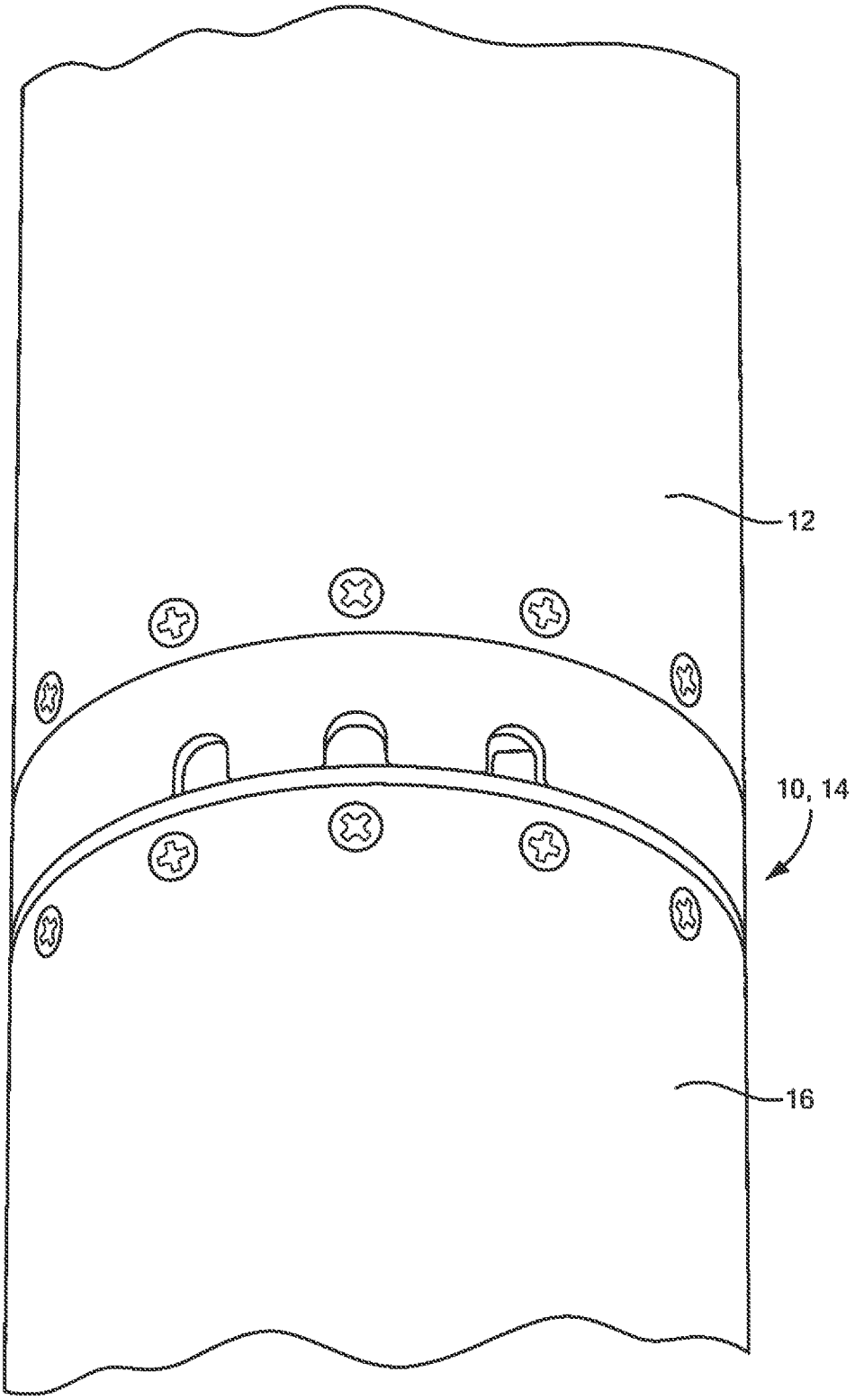
FIG. 9 is a schematic view showing a complete mechanical and electrical connection via the module connector between two underwater vehicle modules.

FIG. 5-9 show how two modules of an underwater vehicle are connected together. In FIG. 5, mating ring 10 has been connected to first module 12 and mating ring 14 has been connected to second module 16. The collar sections of each mating ring preferably slide into their respective modules and fasteners extend through holes 60 in each module and then into the collar sections of each mating ring. Then the one mating ring as shown in FIG. 8 is releasably coupled to the other mating ring while at the same time the electrical connector 22 of mating ring 10 mates with the electrical connector 26 of mating ring 14. Fasteners may be inserted via channel 42 through shelf 32*a* and shelf 32*b* and threaded into corresponding threaded inserts 43 in the distal ends of prongs 34*a* and 34*b*.

The mating rings may be made of aluminum but could be most metals or even plastic.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. An underwater vehicle module connector comprising:

a first mating ring connected to a first module and including a first bulkhead sealing an interior of the first module, a first electrical connector extending outward from the first bulkhead, and a first coupling mechanism;

a second mating ring connectable to a second module and including a second bulkhead sealing an interior of the second module, a second electrical connector extending outward from the second bulkhead, and a second coupling mechanism; and the first and second coupling mechanisms configured to releasably couple the first mating ring to the second mating ring and mate the first electrical connector with the second electrical connector.

2. The connector of claim 1 in which the first and/or second mating rings includes holes or slots therethrough for flooding the volume between the first and second bulkheads.

3. The connector of claim 1 in which the first mating ring bulkhead includes opposing first and second prongs and the second mating ring bulkhead includes opposing third and fourth prongs releasably engaging the first and second prongs, respectively, of the first mating ring.

4. The connector of claim 3 in which the first and second prongs are disposed on opposite sides of the first electrical connector and the third and fourth prongs are disposed on opposite sides of the second electrical connector.

5. The connector of claim 3 in which the first and second prongs extend from first and second outwardly facing shelf members, respectively.

6. The connector of claim 5 in which the third and fourth prongs extend from third and fourth inwardly facing shelf members, respectively.

7. The connector of claim 6 in which the first electrical connector extends in a first direction between the first and second prongs and the second electrical connector faces a second opposite direction between the third and fourth prongs.

8. The connector of claim 6 in which the third and fourth prongs engage said first and second outwardly facing shelf members, respectively, and the first and second prongs engage said third and fourth inwardly facing shelf members, respectively.

9. The connector of claim 1 in which the first electrical connector extends at a right angle relative to the external surface of the first bulkhead and the second electrical connection extends at a right angle relative to the external surface of the second bulkhead.

10. The connector of claim 1 in which the first mating ring further includes a first collar section insertable into the first module and the second mating ring further includes a second collar section insertable into the second module.

11. An underwater vehicle comprising:

at least a first module independently sealed via a first bulkhead including an external surface with a first electrical connector;

at least a second module independently sealed via a second bulkhead including an external surface with a second electrical connector;

a first mechanical coupling mechanism on the external surface of the first bulkhead;

a second mechanical coupling mechanism on the external surface of the second bulkhead; and the second mechanical coupling mechanism configured to releasably engage the first mechanical coupling mechanism securing the first module to the second module and configured to mate the first electrical connector with the second electrical connector.

12. The vehicle of claim 11 in which the first mechanical coupling mechanism includes opposing first and second prongs and the second mechanical coupling mechanism includes opposing third and fourth prongs releasably engaging the first and second prongs, respectively, of the first mechanical coupling mechanism.

13. The vehicle of claim 12 in which the first and second prongs are disposed on opposite sides of the first electrical connector and the third and fourth prongs are disposed on opposite sides of the second electrical connector.

14. The vehicle of claim 12 in which the first and second prongs extend from first and second outwardly facing shelf members, respectively.

15. The vehicle of claim 14 in which the third and fourth prongs extend from third and fourth inwardly facing shelf members, respectively.

16. The vehicle of claim 13 in which the first electrical connector extends in a first direction between the first and second prongs and the second electrical connector faces a second opposite direction between the third and fourth prongs.

17. The vehicle of claim 15 in which the third and fourth prongs engage said first and second outwardly facing shelf members, respectively, and the first and second prongs engage said third and fourth inwardly facing shelf members, respectively.

18. The vehicle of claim 11 in which the first electrical connector extends at a right angle relative to the external surface of the first bulkhead and the second electrical connector extends at a right angle relative to the external surface of the second bulkhead.

19. A method of connecting two modules of an underwater vehicle, the method comprising:

connecting a first mating ring to the first module, the first mating ring including a first bulkhead independently sealing the first module and a first electrical connector extending outward from the first bulkhead;

connecting a second mating ring to a second module, the second mating ring including a second bulkhead independently sealing the second module and a second electrical connector extending outward from the second bulkhead; and releasably coupling the first mating ring to the second mating ring while simultaneously mating the first electrical connector with the second electrical connector.

20. The method of claim 19 further including flooding the space between the first and second bulkheads.

21. The method of claim 19 in which connecting includes engaging first and second prongs with third and fourth prongs.

22. The method of claim 19 in which the first electrical connector is an electrical plug extending at a right angle relative to an external surface of the first bulkhead and the second electrical connector is an electrical socket extending at a right angle relative to an external surface of the second bulkhead, and in coupling the first mating ring to the second mating ring the electrical plug is driven into the electrical socket.

23. An underwater vehicle module connector comprising:

a first mating ring connected to a first module and including a first bulkhead sealing the first module, a first electrical connector extending outward at a right angle from the first bulkhead, and a first coupling mechanism;

a second mating ring connectable to a second module and including a second bulkhead sealing the second module, a second electrical connector extending outward at a right angle from the second bulkhead, and a second coupling mechanism; and the first and second coupling mechanisms configured to releasably couple the first mating ring to the second mating ring and mate the first electrical connector with the second electrical connector.

24. The connector of claim 23 in which the first and/or second mating rings includes holes or slots therethrough for flooding the volume between the first and second bulkheads.

25. The connector of claim 23 in which the first mating ring bulkhead includes opposing first and second prongs and the second mating ring bulkhead includes opposing third and fourth prongs releasably engaging the first and second prongs, respectively, of the first mating ring.

26. The connector of claim 25 in which the first and second prongs are disposed on opposite sides of the first electrical connector and the third and fourth prongs are disposed on opposite sides of the second electrical connector.

27. The connector of claim 25 in which the first and second prongs extend from first and second outwardly facing shelf members, respectively.

28. The connector of claim 27 in which the third and fourth prongs extend from third and fourth inwardly facing shelf members, respectively.

29. The connector of claim 28 in which the first electrical connector extends in a first direction between the first and second prongs and the second electrical connector faces a second opposite direction between the third and fourth prongs.

30. The connector of claim 28 in which the third and fourth prongs engage said first and second outwardly facing shelf members, respectively, and the first and second prongs engage said third and fourth inwardly facing shelf members, respectively.

31. The connector of claim 23 in which the first mating ring further includes a first collar section insertable into the first module and the second mating ring further includes a second collar section insertable into the second module.

32. An underwater vehicle comprising:

at least a first module sealed via a first bulkhead including an external surface with a first electrical connector extending at a right angle relative to the external surface of the first bulkhead;

at least a second module sealed via a second bulkhead including an external surface with a second electrical connector extending at a right angle relative to the external surface of the second bulkhead;

a first mechanical coupling mechanism on the external surface of the first bulkhead;

a second mechanical coupling mechanism on the external surface of the second bulkhead; and the second mechanical coupling mechanism configured to releasably engage the first mechanical coupling mechanism securing the first module to the second module and configured to mate the first electrical connector with the second electrical connector.

33. The vehicle of claim 32 in which the first mechanical coupling mechanism includes opposing first and second prongs and the second mechanical coupling mechanism includes opposing third and fourth prongs releasably engaging the first and second prongs, respectively, of the first mechanical coupling mechanism.

34. The vehicle of claim 33 in which the first and second prongs are disposed on opposite sides of the first electrical connector and the third and fourth prongs are disposed on opposite sides of the second electrical connector.

35. The vehicle of claim 33 in which the first and second prongs extend from first and second outwardly facing shelf members, respectively.

36. The vehicle of claim 33 in which the third and fourth prongs extend from third and fourth inwardly facing shelf members, respectively.

37. The vehicle of claim 33 in which the first electrical connector extends in a first direction between the first and second prongs and the second electrical connector faces a second opposite direction between the third and fourth prongs.

38. The vehicle of claim 36 in which the third and fourth prongs engage said first and second outwardly facing shelf members, respectively, and the first and second prongs engage said third and fourth inwardly facing shelf members, respectively.

39. A method of connecting two modules of an underwater vehicle, the method comprising:

connecting a first mating ring to the first module, the first mating ring including a first bulkhead sealing the first module and a first electrical connector extending outward at a right angle from the first bulkhead;

connecting a second mating ring to a second module, the second mating ring including a second bulkhead sealing the second module and a second electrical connector extending outward at a right angle from the second bulkhead; and releasably coupling the first mating ring to the second mating ring while simultaneously mating the first electrical connector with the second electrical connector.

40. The method of claim 39 further including flooding the space between the first and second bulkheads.

41. The method of claim 39 in which connecting includes engaging first and second prongs with third and fourth prongs.

42. The method of claim 39 in which the first electrical connector is an electrical plug and the second electrical connector is an electrical socket, and in coupling the first mating ring to the second mating ring the electrical plug is driven into the electrical socket.

* * * * *